United States Patent [19]

Brackmann

[11] Patent Number: 4,716,913

[45] Date of Patent: Jan. 5, 1988

[54] COMPOSITE CIGARETTES

[75] Inventor: Warren A. Brackmann, Mississauga, Canada

[73] Assignee: Rothmans of Pall Mall Limited, Toronto, Ontario, Canada

[21] Appl. No.: 862,702

[22] Filed: May 13, 1986

[30] Foreign Application Priority Data

May 15, 1985 [GB] United Kingdom ..... 8512292
Dec. 4, 1985 [GB] United Kingdom ..... 8529852

[51] Int. Cl.[4] ..... A24D 1/00; A24C 5/18

[52] U.S. Cl. ..... 131/364; 131/361; 131/84.4

[58] Field of Search ..... 131/364, 363, 366, 367, 131/84.4, 361

[56] References Cited

U.S. PATENT DOCUMENTS

| | | | |
|---|---|---|---|
| 1,796,522 | 3/1931 | Hopkins | 131/364 |
| 3,059,649 | 10/1962 | Bernhard | 131/363 |
| 3,759,267 | 9/1973 | Thornton | 131/364 |
| 3,795,249 | 3/1974 | Cristiani | 131/84.4 |
| 4,009,722 | 3/1977 | Wahle et al. | 131/84.4 |
| 4,459,998 | 7/1984 | Labbe et al. | 131/364 |
| 4,516,585 | 5/1985 | Pinkham | 131/84.4 |
| 4,593,704 | 6/1986 | Wahle et al. | 131/84.4 |

*Primary Examiner*—J. Miller
*Attorney, Agent, or Firm*—Sim & McBurney

[57] ABSTRACT

An improved composite cigarette comprising a core of lesser quality tobacco smoking material surrounded by an annulus of higher quality tobacco smoking material is described. The improvement resides in the provision of an increased quantity of the annulus material at the lighting end of the cigarette, so as to increase the initial flavor impact and thereby provide more uniform smoke taste characteristics along the length of the cigarette.

11 Claims, 4 Drawing Figures

COMPOSITE CIGARETTES

FIELD OF INVENTION

The present invention relates to composite cigarettes and their manufacture.

BACKGROUND TO THE INVENTION

It is well known, for example, from U.S. Pat. No. 1,829,559, to form cigarettes of two or more different types of smoking materials, wherein one type of smoking material predominates in an inner core while another type of smoking material predominates in an outer annulus.

It is well known that a substantial proportion of the tobacco smoke entering a smoker's mouth results from the burning of tobacco in the peripheral regions of the cigarette. It is estimated that about 80% of the volume of smoke entering the smoker's mouth originates from only about 50% of the weight of tobacco in the cigarette.

Production of a composite cigarette comprising an outer annulus of high quality blended cut lamina material and an inner core of lesser quality smoking material, such as, stem or stalk material, reconstituted tobacco, tobacco substitute or lesser quality shredded lamina, therefore, represents a considerable saving in the cost of cigarette production, since the quantity of the most expensive component, namely the cut lamina material, is decreased substantially, with substantially no loss of overall smoking quality. Structuring cigarettes in the manner described in U.S. Pat. No. 1,829,559, therefore, may be considered beneficial.

When a cigarette is first lit up, however, smoke from the burning of tobacco material in the whole cross section of the cigarette is drawn into the smoker's mouth and not predominantly from burning of the annulus material, thereby producing a different taste for the smoker upon lighting up, than in the later smoking of the cigarette, which is considered undesirable.

The applicant is aware of U.K. Patent Nos. 1,443,402, 1,340,100, 250,063 and 8577/1892 and U.S. Pat. Nos. 1,796,522, 3,059,649, 3,349,776, 3,614,956, 3,759,267 and 3,913,590 relating to various modifications of tobacco smoking qualities along the length of a cigarette and U.S. Pat. Nos. 2,570,270, 3,736,941, 3,987,804, 3,957,062, 4,207,906 and 4,516,585 relating to various procedures for the formation of composite cigarettes of the type described in U.S. Pat. No. 1,829,559.

SUMMARY OF INVENTION

In accordance with the present invention, there is provided an improvement in a composite cigarette having a lighting end and a smoking end and comprising a rod of tobacco material which has a core of particulate tobacco material of lower smoking quality and an annulus of particulate tobacco material having a high smoking quality surrounding the core and enclosed in a paper wrapper. The improvement comprises the tobacco material rod having a higher proportion of the annulus material at the lighting end.

By providing additional quantities of the annulus material in the lighting end of the cigarette, upon the cigarette being lit, the smoke reaching the mouth of the smoker is derived substantially wholly from annulus material. In this way, little or no change in the taste of the tobacco smoke is perceived by the smoker as the burning proceeds from light up to continued smoking.

The provision of the additional quantity of annulus material at the end of the cigarette may be achieved in any desired maner, depending on the manner of formation of the composite cigarettes. The additional quality of annulus material may be provided in the form of a plug of annulus tobacco material or in the form of an increased proportion of annulus material to core material in the cross section of the cigarette at the lighting end.

The proportion of the total length of filler rod which has the increased quantity of annulus material may vary widely. As noted earlier, the purpose of the increased quantity of annulus material is to improve the quality of the smoke reaching the smoker's mouth upon initial light up while the purpose of the composite annulus and core structure is to provide economic use of tobacco while still providing an acceptable taste to the smoker. These requirements may be balanced when determining the proportion of the total length of filler rod which has this increased quantity of annulus material. Generally, a length of rod equivalent to about 1 to 2 puffs for the increased quantity of annulus material is sufficient to provide the desired overall smoking characteristics.

One method of providing such increased quantity of annulus material in the cross-section of the cigarette at the lighting end is the use of existing dense ending techniques conventionally used in cigarette making machines to increase the quantity of tobacco or densify the tobacco at the lighting end of the cigarette.

Such existing dense ending techniques include the use of a rotary trimming cutter which has a pocket or depression formed therein which results in the tobacco filler rod being cut or trimmed to a greater depth of tobacco while in contact with the pocket or depression than for the remainder of the rotation of the cutter. Subsequent wrapping of the trimmed rod in a paper tube increases the density of the rod at the location of the greater depth of tobacco.

When this technique is applied to a composite cigarette filler rod having a core of one type of smoking material and an outer annulus of another type of smoking material, by trimming less annulus material from the filler rod at the lighting end, the subsequent wrapping of the trimmed filler rod in a paper tube to form a uniform diameter cigarette causes compression of the excess annular material at the lighting end, thereby resulting in a greater proportion of annulus material at the lighting end than elsewhere along the length of the cigarette.

Another method of increasing the proportion of annulus tobacco in the lighting end of the cigarette also involves a dense ending technique. In this procedure, the rotary trimming cutter is uniform about its whole periphery and the filler rod may be compressed before encountering the cutter. Such compression is effected at predetermined locations along the length of the filler corresponding to the location of the lighting end. Once tobacco is compressed, it takes some time for the tobacco to resume its uncompressed form. By compressing the filler rod prior to cutter, usually immediately prior to the cutter, in effect less tobacco is trimmed from the rod at the location of the compression, resulting in an increased proportion of annulus material in the lighting end. This tobacco compression may be achieved using a rotary compression device having lobes which mechanically compress the tobacco against the filler rod supporting surface.

Any other convenient dense ending technique may be employed. For example, the cutter may be periodically moved away from the filler rod to decrease the amount of annulus tobacco trimmed from the rod during such period.

In these dense ending techniques, the increased quantity of annulus material in the lighting end of the cigarette is achieved by increasing the proportion of annulus material to core material. The quantity of core material at the lighting end is the same as elsewhere along the length of the rod but is somewhat compressed by the greater amount of annulus material which must be accommodated in the diameter of the cigarette.

The greater proportion of annulus material at the lighting end also may be provided by decreasing the quantity of core material in the cigarette cross-section while at least proportionally increasing the quantity of annulus material. If desired, the increased quantity of annulus material may be provided by a plug composed wholly of annulus material, for example, by periodically feeding all annulus material to the cigarette filler rod former.

DESCRIPTION OF PREFERRED EMBODIMENTS

Figure 1:
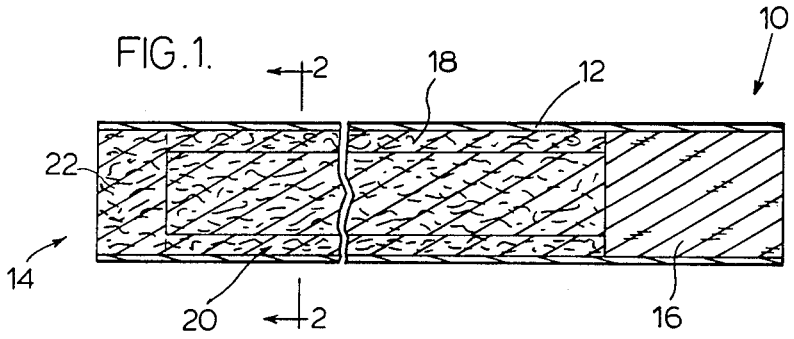
FIG. 1 is a longitudinal cross-sectional view, taken on line 1—1 of FIG. 2, of one form of composite cigarette provided in accordance with one embodiment of the invention.
Figure 2:
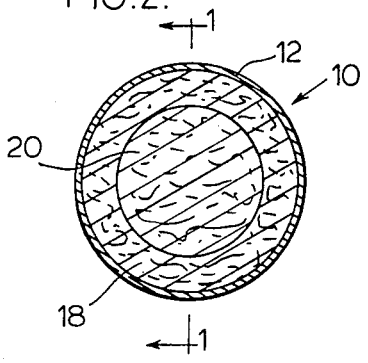
FIG. 2 is a transverse cross-sectional view of the cigarette of FIG. 1 taken on line 2—2 of FIG. 1.

Referring first to FIGS. 1 and 2, there is illustrated therein a novel cigarette 10 comprising an outer paper tube 12 enclosing an elongate rod 14 of smoking material and a filter plug 16. The elongate rod 14 of smoking material comprises an annulus 18 of tobacco smoking material of a first smoking quality extending for a substantial proportion of the length of the rod 14 and surrounding a core 20 of lesser quality tobacco smoking material. A plug 22 of annulus material is provided at the lighting end of the cigarette 10.

The tobacco material which forms the annulus 18 and the end plug 22 is of high quality, usually a blend of cut lamina material such as is conventionally used in cigarette making, while the tobacco material which forms the core 20 is of less quality. The core 20 may comprise a blend of cut lamina of lesser smoking quality than that of the annulus, lesser quality tobacco material, such as processed tobacco ribs, stem or stalk material, optionally blended with cut lamina material, reconstituted tobacco, a tobacco substitute or mixtures of two or more such materials.

As noted earlier, a substantial proportion of the tobacco smoke entering a smoker's mouth from a lit cigarette results from the burning of tobacco in the peripheral regions of the cigarette. The presence of the core 20 of lesser quality smoking material enables lesser quantities of the more expensive cut lamina material to be employed in the cigarette 10 without significantly impairing the overall smoking characteristics of the cigarette.

However, as noted earlier, upon initial light-up of the cigarette, the smoke is drawn from tobacco in the whole diameter of the cigarette. The presence of the end plug 22 composed wholly of cut lamina material results in all lamina material being burned upon initial light-up of the cigarette. In this way the taste of the smoke to the smoker is substantially the same upon light-up as that of smoke resulting predominantly the region of the annulus 14 during subsequent burning of the cigarette.

Figure 3:
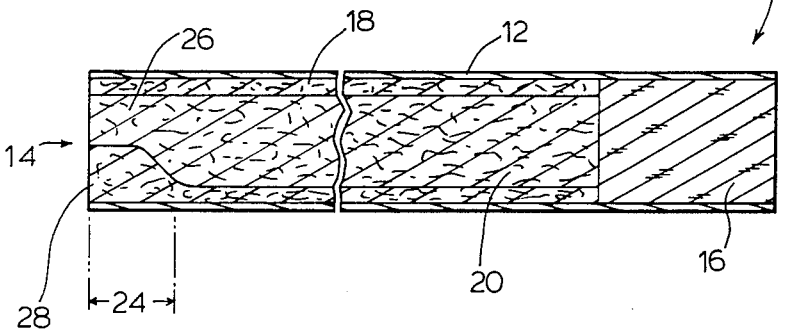
FIG. 3 is a longitudinal cross-sectional view of another form of composite cigarette provided in accordance with another embodiment of this invention.

Referring now to FIG. 3, there is illustrated therein a cigarette 10′ constructed in accordance with another embodiment of the invention. In common with the embodiment of FIGS. 1 and 2, the cigarette 10′ has a paper wrapper 12, a filler rod 14, a filter 16, an annulus 18 of one type of tobacco smoking material and a core 20 of lesser quality smoking material.

In the cigarette 10′, the lighting end region 24, comprises a central region 26 of core material of lesser diameter than the core 20 in the remainder of the length of the filler rod 14 and an outer region 28 of annulus material of greater diameter than the annulus 18 in the remainder of the length of the filler rod 14. At the lighting end of the cigarette 10′, there exists a region of increased amount of annulus tobacco.

The increased amount of annulus material may be present in combination with the same quantity of core material in the region 26 as in the remainder of the length of the filler rod but compressed to a smaller diameter, especially when a dense-ending technique, as described above, is used to manufacture the cigarette 10′.

The presence of the end region 24 having an increased proportion of annulus material therein achieves the same or similar effect upon initial light-up of the cigarette as the provision of the end plug 22 in the embodiment of FIG. 1. The taste of the cigarette smoke is substantially the same at light-up as during subsequent smoking of the cigarette.

Figure 4:
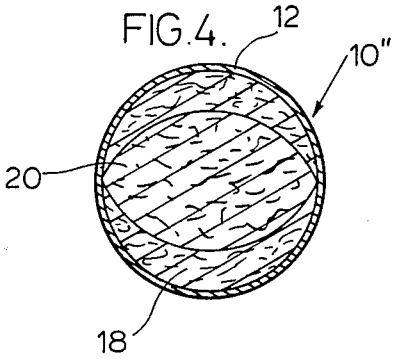
FIG. 4 is a transverse cross-sectional view of a further form of composite cigarette provided in accordance with a further embodiment of this invention.

In FIG. 4, there is shown a transverse cross-section of a cigarette 10″ having an alternative cross-sectional arrangement of annulus 18 and core 20. As shown, the annulus material is shown as comprising opposed substantially crescent-shaped portions surrounding a substantially elliptical core 20.

The composite cigarette filler rod comprising a core of one type of smoking material and an annulus of another type of smoking material may be formed by modification of conventional cigarette-forming procedures. In such procedures, an air-permeable collecting surface moves transverse to a vertically-moving thin shower of tobacco, collects the tobacco thereon and builds up the tobacco filler rod across the width of the shower, and the filler rod, after trimming, enters a garniture for formation of a cigarette rod by wrapping a paper web around the filler rod. Modification to such procedure to effect composite rod formation may be achieved in any convenient manner, such as is described in any one of U.S. Pat. Nos. 3,736,941, 3,987,804, 3,957,062 and 4,207,906 referred to above and the disclosures of which are incorporated herein by reference.

Accordingly, the present invention also includes an improvement in a method for the formation of a cigarette rod by forming substreams of particulate tobacco from a source thereof, assembling a filler rod from the substreams, trimming excess tobacco from the filler rod, and wrapping the trimmed rod in a paper wrapper. The improvement in the latter method resides in the combination of (a) providing at least two of the substreams from higher smoking quality tobacco material and at least one of the substreams from lower smoking quality tobacco material, (b) assembling the substreams to provide a layer of the lower smoking quality tobacco material from the at least one substream thereof located between upper and lower layers of the higher smoking quality material, and (c) providing a quantity of untrimmed higher quality tobacco material in the cross-section of the trimmed rod at longitudinally spaced-apart locations corresponding to the lighting end of cigarettes to be formed from the cigarette rod.

In one particularly convenient technique, at least two substream of annulus tobacco smoking material and at least one substream of core tobacco smoking material are formed from showers of annulus material and core material respectively, the substreams are then layered with one of the substreams of annulus material constituting the bottom layer, one of the substreams of annulus material constituting the top layer and the at least one substream of core material being located in between the top and bottom layers, to form a filler rod. By first forming substreams of the materials of constitution of the composite cigarette, complete control over the assembly of the filler rod is achieved and high speed operation is possible.

The formation of cigarette filler rods from substreams of tobacco by layering of the same has previously been described in U.S. Pat. Nos. 3,980,088 and 3,989,052, assigned to the assignee herein and the disclosures of which are incorporated herein by reference. There is no suggestion in these prior patents, however, to modify the procedure set forth therein to form composite cigarettes in the manner just described.

In the simplest form of this substream assembly procedure, the substreams which are deposited on the rod-forming surface have substantially the same width, so that, upon wrapping of the resulting filler rod, the annulus material assumes the form of two opposed generally-crescent shapes surrounding a generally elliptical core, as illustrated in FIG. 4.

However, a plurality of different forms of substream may be formed from the tobacco shower and assembled to form an approximately square cross-sectional filler rod having an approximately square cross-sectional core approximately centrally located therein, so that, upon wrapping of the filler rod in the paper wrapper and squeezing to a circular cross section, there is produced a cigarette having a circular core surrounded by a cylindrical annulus, as illustrated in FIG. 2.

SUMMARY OF DISCLOSURE

In summary of this disclosure, the present invention provides a novel composite cigarette structure having improved smoking characteristics by providing an increased quantity of annulus material at the lighting end. Modifications are possible within the scope of this invention.

What we claim is:

1. A composite cigarette having a lighting end and a smoking end and comprising a rod of tobacco material consisting wholly of tobacco material and having a core of particulate tobacco material having a lower smoking quality and an annulus of particulate tobacco material having a higher smoking quality enclosed in a paper wrapper, said tobacco material rod having a higher proportion of said annulus material at said lighting end.

2. The cigarette of claim 1, wherein said higher proportion of annulus material is provided by a plug of annulus material provided at the lighting end.

3. The cigarette of claim 1, wherein said higher proportion of annulus material is provided by a greater quantity of annulus material as compared with core material at the lighting end than elsewhere along the length of the tobacco material rod.

4. The cigarette of claim 3 wherein said core material at said lighting end has the same quantity of core material as elsewhere along the length of the tobacco rod and is compressed to a smaller cross-sectional dimension.

5. The cigarette of claim 1 wherein said annulus tobacco material is a blend of cut tobacco lamina having an acceptable smoke producing quality.

6. The cigarette of claim 5 wherein said core tobacco material is provided by processed ribs, stem or stalk, reconstituted tobacco or a tobacco substitute in particulate form.

7. The cigarette of claim 5 wherein said core tobacco material is a blend of cut lamina of lesser quality than the blend of cut tobacco used in the annulus.

8. The cigarette of claim 1 comprising said annulus material substantially in the form of a cylinder surrounding and enclosing a rod of said core material having a substantially circular cross-section-substantially coaxially arranged with respect to the annulus material.

9. The cigarette of claim 1 comprising said annulus material in the form of a pair of opposed general crescent shape surrounding and enclosing a core of generally elliptical cross section.

10. In a method for the formation of a cigarette rod by forming substreams of particulate tobacco from a source thereof, assembling a filler rod from the substreams, trimming excess tobacco from the filler rod, and wrapping the trimmed rod in a paper wrapper, the improvement which comprises:

providing at least two of said substreams from higher smoking quality tobacco material and at least one of said substreams from lower smoking quality tobacco material, assembling said substreams to provide a continuous filler rod comprising a layer of said lower smoking quality tobacco material from said at least one substream thereof located between upper and lower layers of said higher quality smoking material, and providing a quantity of untrimmed higher quality tobacco material at longitudinally spaced-apart locations of the trimmed rod corresponding to the lighting end of cigarettes to be formed from the cigarette rod.

11. The method of claim 10 wherein said substreams have substantially the same width, whereby, upon wrapping the trimmed rod, there is provided a cigarette having a pair of opposed crescent shapes of annulus material enclosing core material.

* * * * *